United States Patent [19]

Friese et al.

[11] Patent Number: 4,744,794

[45] Date of Patent: May 17, 1988

[54] LEATHER FATLIQUORING AGENTS COMBINABLE WITH TANNING AND RETANNING COMPOSITIONS

[75] Inventors: Hans-Herbert Friese, Monheim; Uwe Ploog, Haan; Friedrich Pieper, Langenfeld, all of Fed. Rep. of Germany

[73] Assignee: Henkel Kommanditgesellschaft auf Aktien, Duesseldorf, Fed. Rep. of Germany

[21] Appl. No.: 38,411

[22] Filed: Apr. 10, 1987

Related U.S. Application Data

[63] Continuation of Ser. No. 736,745, May 22, 1985, abandoned.

[30] Foreign Application Priority Data

May 24, 1984 [DE] Fed. Rep. of Germany ..... 3419405

[51] Int. Cl.[4] ..... C14C 5/00; C14C 11/00; C14C 9/00

[52] U.S. Cl. ..... 8/94.23; 252/8.57

[58] Field of Search ..... 8/94.22, 94.23; 252/8.57

[56] References Cited

U.S. PATENT DOCUMENTS

| | | | |
|---|---|---|---|
| 3,826,610 | 7/1974 | Komarek et al. | 8/94.26 |
| 3,927,966 | 12/1975 | Leberfinger et al. | 8/94.2 |

FOREIGN PATENT DOCUMENTS

| | | |
|---|---|---|
| 598300 | 6/1934 | Fed. Rep. of Germany . |
| 1669347 | 3/1971 | Fed. Rep. of Germany . |
| 1559985 | 3/1969 | France . |
| 2145338 | 2/1973 | France . |
| 2249952 | 5/1975 | France . |

OTHER PUBLICATIONS

European Search Report, 85106102.8–Chemical Abstracts, 43–Wood Products, vol. 72, 1970, 56855, (56737z).

*Primary Examiner*—Paul Lieberman
*Assistant Examiner*—John F. McNally
*Attorney, Agent, or Firm*—Ernest G. Szoke; Henry E. Millson, Jr.; Mark A. Greenfield

[57] ABSTRACT

A leather fatliquoring agent and a process for its use in which the agent is a sulfosuccinic ($C_{12-24}$ fatty residue) ester and an anionic or nonionic emulsifier. The agent is stable in the presence of tanning liquor electrolytes.

19 Claims, No Drawings

LEATHER FATLIQUORING AGENTS COMBINABLE WITH TANNING AND RETANNING COMPOSITIONS

This application is a continuation of application Ser. No. 736,745, filed May 22, 1985, now abandoned.

BACKGROUND OF THE INVENTION

1. Field of the Invention

This invention relates to fatliquoring agents which may be used simultaneously with electrolyte tanning liquors in leather manufacture.

2. Statment of the Related Art

Generally, the process steps in the manufacture of leather from hides which have already been fleshed, unhaired, bated, and pickled, comprise sequentially: tanning (to convert the hide into a stable, non-putrescible material, usually using chromium or aluminum salts); wringing (to remove excess moisture); splitting and shaving/skiving (to adjust the thickness); retanning (to impart desirable properties of other tanning agents); coloring or tinting (where desired); fatliquoring (to lubricate the fibers for flexibility); followed by various non-chemical steps such as conditioning, staking, buffing, finishing, and plating. The existence of so many steps results in a labor-intensive and/or machinery-intensive manufacturing process with resultant high costs. Therefore, anything which will combine steps or reduce or eliminate a step is of great economic importance, in addition to any improved properties of the leather that may result. Furthermore, it would be useful if a fat-liquoring composition could be at least partially combined with the tanning and/or retanning compositions. This would increase leather suppleness and grain stability, and also would make the fatliquor composition more versatile, since it would not be necessary to remove the tanning liquor when fatliquoring.

Published German patent application No. 16 69 347 describes a process for the fatliquoring of leather using water-emulsifiable sulfosuccinic acid esters which have been obtained by the esterification of fat- or oil-like compounds containing alcoholic hydroxyl groups and also lipophilic residues with maleic acid anhydride followed by reaction of the esterification product with a sulfite or bisulfite in a quantity substantially equimolar to the maleic acid anhydride used. However, the use of compounds such as these is confined to fatliquoring. They cannot be used during chrome or aluminum tanning or retanning on account of the inadequate emulsion stability of the sulfosuccinic acid esters with respect to chromium or aluminum salts, and therefore cannot afford the advantages of the present invention.

DESCRIPTION OF THE INVENTION

It has now surprisingly been found that sulfosuccinic acid esters may be used as fatliquoring agents in the tanning liquor in the manufacture of leather and skins, even during chrome tanning or aluminum tanning or retanning, providing they are combined with certain anionic or nonionic emulsifiers.

Other than in the operating examples, or where otherwise indicated, all numbers expressing quantities of ingredients, reaction conditions, or defining ingredient parameters used herein are to be understood as modified in all instances by the term "about".

Accordingly, the present invention relates to a process for making leather and skins by chrome or aluminum tanning or retanning, characterized by the use of a combination of (A) from 40 to 90 (preferably 50 to 85)% by weight of sulfosuccinic acid esters containing $C_{12-24}$ fatty residues as esterification component, and (B) the balance to 100% by weight of nonionic and/or anionic emulsifiers selected from the group comprising (a) alkylene oxide adducts with $C_{8-20}$ fatty alcohols, alkyl phenols, fatty acids or fatty acid alkanolamides or (b) sulfuric acid esters thereof in the form of their alkali, ammonium or amine salts.

The combination is used in a total quantity of 0.1 to 6.0 (preferably 0.5 to 4.0)% by weight based on the weight of the dehaired or shaved skins, as a fat-liquoring agent which may be mixed with the tanning liquor, the amount used depending upon the type of leather being manufactured. The components may be added to the liquor either separately or in the form of a made-up product.

The sulfosuccinic acid esters (A) are produced in known manner by esterifying maleic acid anhydride with 1 to 2 equivalents of the desired esterification component and reacting the esterification product with a sulfite or bisulfite in a quantity substantially equivalent to the maleic acid anhydride. Compounds containing $C_{12-24}$ fatty residues and hydroxyl groups may be used as the esterification component.

The fatty residues may be saturated or unsaturated, linear or branched. They may be derived from: fatty alcohols; branched-chain alcohols produced by oxo-synthesis; fatty acid mono- or diglycerides, for example $C_{12-18}$ coconut oil fatty alcohol, $C_{16-18}$ tallow alcohol, $C_{8-24}$ oxoalcohol, $C_{16-18}$ tallow fatty acid monoglyceride; or from adducts of 1 to 6 mols of alkylene oxide with the fatty alcohols or fatty acid glycerides mentioned or with fatty acids, for example the adduct of 2 to 3 mols of ethylene oxide with $C_{16-18}$ tallow fatty alcohol, the adduct of 4 to 6 mols of ethylene oxide with a mixture of $C_{16-24}$ fatty acids, or the adduct of 2 mols of ethylene oxide with a mixture of $C_{12-18}$ fatty acids. The sulfosuccinic acid esters are used in the form of their salts, preferably their sodium and/or ammonium salts.

Suitable emulsifiers (B), which are used in combination with the sulfosuccinic acid esters (A), include the adducts of from 5 to 25 mols of ethylene oxide with $C_{8-20}$ fatty alcohols or alkyl phenols, such as $C_{12-18}$ coconut oil fatty alcohol+8 EO, $C_{16-18}$ tallow fatty alcohol+20 EO, nonyl phenol+9 EO, or the sulfates of the adducts of 1 to 6 mols of ethylene oxide with $C_{8-20}$ fatty alcohols, fatty acids or fatty acid alkanolamindes, for example the sulfates of $C_{12-18}$ coconut oil fatty acid ethanolamide+2 EO, $C_{8-16}$ fatty acid ethanolamide+2 EO or $C_{12-18}$ coconut oil fatty alcohol+5 EO, in the form of their alkali or ammonium salts, preferably their sodium salts.

The sulfosuccinic acid esters are added to the tanning or retanning liquors together with the emulsifiers before, during or after addition of the tanning electrolytes. That is, the two agents are added together or separately at any point during the manufacturing process in which fatliquoring or preliminary fatliquoring is desired, and since the agents are compatible with the tanning liquor, there is no need to change liquors when tanning, pretanning, or retanning. The liquors are simply mixed together. The liquors are distinguished by their high stability. Very supple leathers and skins are obtained. Their grain stability is considerably improved by comparison with the sulfitation products normally used.

In the process according the invention, the sulfosuccinic acid esters (A) and emulsifiers (B) may be used in the tanning liquor together with standard electrolyte-resistant fat-liquoring agents, such as sulfited oils, for example fish oil, or agents produced by sulfochlorination and subsequent hydrolysis of unsaturated fatty acid esters, such as tallow fatty acid methyl ester, or long-chain paraffins, for example chloroparaffin sulfonate.

EXAMPLES

I. Production Examples for Sulfosuccinic Acid Esters

1. $C_{16-18}$ alkyl sulfosuccinate, Na/ammonium salt 192.3 g (0.72 mol) of oleyl cetyl alcohol (I.V. 50.5, OH No. 209) were introduced into a 2-liter three-necked flask equipped with a nitrogen inlet, stirrer and thermometer and reacted at <80° C. with 70.2 g (0.72 mol) of maleic acid anhydride. After an acid number of 155 had been reached, a solution of 69.5 g (0.37 mol) of sodium bisulfite in 615.5 g of water and 52.5 g of concentrated ammonia was added to the reaction product at around 60° C., followed by stirring for 3.5 hours at 60°-65° C. The end product was adjusted to pH 7 with ammonia water (10%). Appearance: milky, low-viscosity, highly stable suspension.

2. Sulfosuccinate based on glycerin dioleate 218 g (0.35 mol) of glycerin dioleate and 34.5 g (0.35 mol) of maleic acid anhydride were heated with stirring in a nitrogen atmosphere until an acid number of 80 had been reached. 35 g (0.18 mol) of sodium bisulfite dissolved in 300 g of water and neutralized with approx. 27 g of concentrated ammonia were then added and the mixture stirred for 1 hour at 75° C. A white emulsion having a solids content of 53% was obtained.

3. $C_{12-18}$ alkyl sulfosuccinate, Na salt.

207 g (1 mol) of $C_{12-18}$ coconut oil fatty alcohol (tech.) and 98 g (1 mol) of maleic acid anhydride were stirred in a nitrogen atmosphere until an acid number of 185 had been reached and then reacted while stirring at 75° C. with a solution of 132.5 g (1.05 mol) of sodium sulfite in 1020 g of water; time 1 hour. A paste containing approx. 30% of active sulfosuccinic acid esters solidifying at room temperature, was obtained.

II. Application Examples in Leather Manufacturing

4. Chrome tanning of napa (sheepskin) leather

| starting material: lined (unhaired) and skived (split) cowhide - about 2.5 mm. | | | |
|---|---|---|---|
| Step | Percent | ingredient, processing sequence | time (minutes) |
| Washing | 300. | water at 35° C., drain liquor | 15 |
| Deliming | | no liquor, | 45 |
| | 1.2 | a buffer mixture of organic and inorganic acids, | |
| | 0.3 | sodium disulfite, | |
| | 0.3 | nonyl phenol + 10 E.O. | |
| Bating | 1. | enzymatic bate, drain liquor | 60 |
| Washing | 300. | water at 35° C., drain liquor | 15 |
| Pickling | 70. | water at 20° C., | 10 |
| | 8. | common salt, | |
| | 0.5 | formic acid, | 30 |
| | 0.8 | sulfuric acid, | 90 |
| | | then allow to stand | overnight |
| Tanning | | inventive agents, comprising | 30 |
| combined | 0.3 | $C_{16-18}$ fatty alcohol +20 E.O. | |
| with | 1.7 | $C_{16-18}$ alkyl sulfosuccinate, | |
| preliminary | | Na salt | |
| fatliquoring | 8. | chrome tanning composition (25% $Cr_2O_3$/33% basic) | 60 |
| | 0.5 | MgO | 300 |

-continued

| starting material: lined (unhaired) and skived (split) cowhide - about 2.5 mm. | | | |
|---|---|---|---|
| Step | Percent | ingredient, processing sequence | time (minutes) |
| then retan, dye, fatliquor, and finish leather in usual manner | | | |

In Examples 4 through 9, the column headed "percent" refers to the percentage of each ingredient by weight, based upon the dry weight of the starting material.

5. Retanning of napa (sheepskin) leather

| starting material: chrome tanned cowhide - 1 mm thick | | | |
|---|---|---|---|
| step | percent | ingredient, processing sequence | time (minutes) |
| Washing | 300. | water at 45° C., drain liquor | 15 |
| Retanning | 100. | water at 45° C., | 15 |
| and | 2. | chrome tanning composition | |
| fatliquoring | | (25% $Cr_2O_3$/33% basic), | |
| | 2. | amphoteric auxiliary tanning composition | |
| | 0.7 | sodium-aluminum silicate, then | |
| | 2. | inventive agents, comprising: | 45 |
| | | 3 parts of $C_{16-18}$ fatty alcohol + 20 E.O., 17 parts of $C_{16-18}$ alkyl sulfosuccinate, Na salt | |
| Washing | 300. | water at 45° C., drain liquor | 15 |
| then neutralize, dye, fatliquor, and finish leather in usual manner | | | |

6. Chrome tanning of soft upper leather (cowhide)

| starting material: lined and skived cowhides - about 4 mm thick | | | |
|---|---|---|---|
| step | percent | ingredient, processing sequence | time (minutes) |
| Washing | 300. | water at 35° C., drain liquor | 15 |
| Deliming | | no liquor, | 45 |
| | 1.2 | buffer mixture ("Rectil" EH)* | |
| | 0.3 | sodium disulfite | |
| | 0.2 | nonyl phenol + 10 E.O. | |
| Bating | 0.5 | enzymatic bate, drain liquor | 30 |
| Washing | 300. | water at 35° C., drain liquor | 15 |
| Pickling | 70. | water at 20° C. | 10 |
| | 8. | common salt, | |
| | 0.5 | formic acid, | 30 |
| | 0.8 | sulfuric acid, | 90 |
| | | then allow to stand | overnight |
| Tanning | 0.5 | inventive agents, comprising: | 30 |
| and preliminary fatliquoring | | 2 parts of nonyl phenol + 10 E.O., 3 parts of $C_{12-24}$ fatty acid (+ 3 E.O.) sulfosuccinate, Na salt | |
| | 8.0 | chrome tanning composition ( 25% $Cr_2O_3$/33% basic) | 60 |
| | 0.5 | MgO, final pH about 3.8 | 300 |
| then neutralize, dye, fatliquor, and finish leather in usual manner | | | |

Notes: *primarily amidosulfonic acid and ammonium sulfate. A trademark of Henkel KGaA, Duesseldorf, F.R. Germany 7. Retanning of soft upper leather (cowhide)

| starting material: chrome tanned cowhide - 1.6 mm thick | | | |
|---|---|---|---|
| step | percent | ingredient, processing sequence | time (minutes) |
| Washing | 300. | water at 45° C., drain liquor | 15 |
| Retanning | 100. | water at 45° C., | 15 |
| and | 3. | chrome tanning composition | |
| fatliquoring | | (25% $Cr_2O_3$/33% basic), | |

-continued

| starting material: chrome tanned cowhide - 1.6 mm thick | | | |
|---|---|---|---|
| step | percent | ingredient, processing sequence | time (minutes) |
| | 3. | amphoteric auxiliary tanning composition ("Pellupur" NB)*, | |
| | 1. | sodium-aluminum silicate ("Coratyl" G)** | |
| | 1. | inventive agents, containing 2 parts of nonyl phenol + 9 E.O. 3 parts of $C_{12-18}$ fatty acid (+ 2 E.O.) sulfosuccinate, Na salt | 45 |
| Washing | 300. | water at 45° C., drain liquor | 15 |
| then neutralize, dye, fatliquor, and finish is usual manner | | | |

notes:

*a condensation product based upon aromatic sulfonic acids. A trademark of Henkel KGaA, Duesseldorf, F.R. Germany

**primarily zeolite A. A trademark of Henkel KGaA, Duesseldorf, F.R. Germany

8. Production of leather for clothing

| starting material: pickled New Zealand sheepskin | | | |
|---|---|---|---|
| step | percent | ingredient, processing sequence | time (minutes) |
| De-greasing | 200. | water at 38° C., | 30 |
| | 10. | common salt, | |
| | 1. | nonyl phenol + 10 E.O., scrape and weigh | |
| | 25. | water at 38° C., | 40 |
| | 4. | nonyl phenol + 10 E.O. | |
| Pre-liminary tanning | +50. | water at 38° C., | 20 |
| | 5. | common salt, then add | |
| | 2. | glutaraldehyde, then add | 40 |
| | 1. | adipic acid (tech. grade), | 30 |
| | 3. | sodium-aluminum silicate ("Coratyl" G) | |
| | +50. | water at 38° C., then add | 30 |
| | +100. | water at 45° C., pH about 4, rinse at 45° C. until the liquor is clear | 60 |
| Pickling | 80. | water at 20° C., | } 10 |
| | 10. | common salt, | |
| | 1. | formic acid | 30 |
| Pre-liminary fat-liquoring | 2. | inventive agents, comprising 1 part of $C_{12-18}$ fatty alcohol (+ 5 E.O.) sulfate, Na salt 1 part of $C_{16-18}$ alkyl sulfo-succinate, Na salt, then add | 30 |
| Tanning | 6. | chrome tanning composition (25% $Cr_2O_3$/33% basic) | 30 |
| | 0.3 | MgO, pH about 3.8 | 330 |
| then neutralize, retan, fatliquor and finish in usual manner | | | |

9. Production of lamb velour

| starting material: washed and degreased lambskins | | | |
|---|---|---|---|
| step | quantity (g/l) | ingredient, processing sequence, | time (minutes) |
| Pickling | 60 | common salt (liquor 30° C.) | 10 |
| | .5 | $C_{12-18}$ alkyl sulfate, Na salt | 5 |
| | 5 (ml) | formic acid, drain liquor, permit skins to drip-dry | overnight |
| Tanning and fatliquoring | 50 | common salt (liquor 30° C.), then | 10 |
| | .5 | formic acid, pH about 3.5, then | 5 |
| | 6. | chrome tanning composition (25% $Cr_2O_3$/33% basic), then | 60 |
| | 6. | chrome tanning composition (25% $Cr_2O_3$/33% basic), then | 60 |
| | 1.5 | inventive agent (A) comprising $C_{12-18}$ alkylsulfosuccinate, Na salt, and | 60 |
| | 1.5 | inventive agent (B) comprising $C_{12-18}$ fatty acid mono-ethanolamide (+ 2 E.O.)sulfate, added independently, then | |
| | 6. | chrome tanning composition (25% $Cr_2O_3$/33% basic), with periodic stirring, then | overnight |
| | — | alkalinize with $Na_2CO_3$ to pH of 3.8–4, then | — |
| | — | after-run cold rinse, then | 180 |
| | — | rack skin and leave | 1 day |
| then dry, stake, degrease by machine, buff-dye, and finish in usual manner | | | |

We claim:

1. In a continuous leather manufacturing process for treating hides by non-sequentially tanning, pretanning and/or retanning with chromimum or aluminum electrolyte-containing liquors, fatliquoring, and other known chemical processing steps, the improvement comprising using a fatliquoring agent which is stable in the presence of said electrolyte-containing tanning liquors, and wherein said tanning liquors and said fatliquor are at least partially associated with one another by adding said fatliquoring agent to the tanning or retanning liquor before, during, or after the addition of the chromium or aluminum electrolytes, so that said agent and said electrolytes are simultaneously present, said fatliquoring agent comprising (A) about 40 to 90% by weight of at least one sulfosuccinic acid ester or its salt, whose esterification component is a $C_{12-24}$ fatty residue which is alkoxylated or non-alkoxyulated; in combination with (B) the balance to 100% by weight of at least one nonionic or anionic emulsifier which is (a) an alkoxylated $C_{8-20}$ compound selected from fatty alcohol, alkyl phenol, fatty acid, fatty acid alkanolamide, or (b) a sulfuric acid eater of the foregoing or said eaters' alkali, ammonium, or amine salt.

2. The process of claim 1 wherein in ingredient (A) said esterification component is:

(1) $C_{12-24}$ fatty alcohol, (2) $C_{12-\geq}$fatty acid mono- or di-glyceride, (3) an adduct of the foregoing with 1–6 mols of alkylene oxide, or (4) an adduct of $C_{12-24}$ fatty acid with 1–6 mols of alkylene oxide.

3. The process of claim 1 wherein ingredient (B) is (a) and is alkoxylated with 5 to 25 mols of ethylene oxide, or is (b) and is alkoxylated with 1 to 6 mols of ethylene oxide.

4. The process of claim 2 wherein ingredient (B) is (a) and is alkoxylated with 5 to 25 mols of ethylene oxide, or is (b) and is alkoxylated with 1 to 6 mols of ethylene oxide.

5. The process of claim 1 wherein (A) is at least one of:

(1) $C_{16-18}$ alkyl sulfosuccinate, sodium or ammonium salt;

(2) sulfosuccinate based on glycerin dioleate;

(3) $C_{12-18}$ alkyl sulfosuccinate, sodium salt;

(4) $C_{12-24}$ fatty acid (+3 E.O.) sulfosuccinate, sodium salt; or (5) $C_{12-18}$ fatty acid (+2 E.O.) sulfosuccinate, sodium saalt.

6. The process of claim 1 wherein (B) is at least one of:

(1) $C_{16-18}$ fatty alcohol+20 E.O.;
(2) nonyl phenol+10 E.O.;
(3) nonyl phenol+9 E.O.;
(4) $C_{12-18}$ fatty alcohol (+5 E.O.) sulfate, sodium salt; or
(5) $C_{12-18}$ fatty acid monoethanolamide (+2 E.O.) sulfate.

7. The process of claim 5 wherein (B) is at least one of:

(1) $C_{16-18}$ fatty alcohol+20 E.O.;
(2) nonyl phenol+10 E.O.;
(3) nonyl phenol+9 E.O.;
(4) $C_{12-18}$ fatty alcohol (+5 E.O.) sulfate, sodium salt; or
(5) $C_{12-18}$ fatty acid monoethanolamide (+2 E.O.) sulfate.

8. The process of claim 1 wherein ingredient (A) is present in about 50 to 85% by weight.

9. The process of claim 2 wherein ingredient (A) is present in about 50 to 85% by weight.

10. The process of claim 3 wherein ingredient (A) is present in about 50 to 85% by weight.

11. The process of claim 7 wherein ingredient (A) is present in about 50 to 85% by weight.

12. The process of claim 1 wherein said agent is used in a total quantity of about 0.1 to 6.% by weight based on the total weight of said hides.

13. The process of claim 3 wherein said agent is used in a total quantity of about 0.1 to 6.% by weight based on the total weight of said hides.

14. The process of claim 7 wherein said agent is used in a total quantity of about 0.1 to 6.% by weight based on the total weight of said hides.

15. The process of claim 1 wherein said agent is used in a total quantity of about 0.5 to 4.% by weight based on the total weight of said hides.

16. The process of claim 3 wherein said agent is used in a total quantity of about 0.5 to 4.% by weight based on the total weight of said hides.

17. The process of claim 7 wherein said agent is used in a total quantity of about 0.5 to 4.% by weight based on the total weight of said hides.

18. The process of claim 2 wherein said tanning liquor electrolytes are at least aluminum or chromium.

19. The process of claim 7 wherein said tanning liquor electrolytes are at least aluminum or chromium.

* * * * *